US009587405B1

(12) United States Patent
Alhazza

(10) Patent No.: US 9,587,405 B1
(45) Date of Patent: Mar. 7, 2017

(54) PORTABLE FOLDING RAMP

(71) Applicant: Hebah A. Alhazza, Qortuba (KW)

(72) Inventor: Hebah A. Alhazza, Qortuba (KW)

( * ) Notice: Subject to any disclaimer, the term of this patent is extended or adjusted under 35 U.S.C. 154(b) by 0 days.

(21) Appl. No.: 15/188,889

(22) Filed: Jun. 21, 2016

(51) Int. Cl.
*E04F 11/00* (2006.01)

(52) U.S. Cl.
CPC ..... *E04F 11/002* (2013.01); *E04F 2011/005* (2013.01)

(58) Field of Classification Search
CPC ..... E04F 11/002; E04F 11/00; E04F 11/06; E04F 2011/005; B65G 69/30; A61G 3/061
USPC ..... 14/69.5
See application file for complete search history.

(56) References Cited

U.S. PATENT DOCUMENTS

| | | | | |
|---|---|---|---|---|
| 3,612,366 | A * | 10/1971 | Schneider | B60P 3/1025 224/310 |
| 4,528,711 | A | 7/1985 | Packer | |
| 4,712,264 | A | 12/1987 | Voith | |
| 5,077,852 | A | 1/1992 | Karlsson | |
| 5,137,114 | A | 8/1992 | Yde et al. | |
| 5,538,308 | A * | 7/1996 | Floe | B60P 1/435 296/61 |
| 5,678,984 | A * | 10/1997 | Petersen | B60P 1/43 14/71.7 |
| 6,269,508 | B1 * | 8/2001 | Younce | B65G 69/30 14/69.5 |
| 6,345,950 | B1 | 2/2002 | Gerwitz | |
| 6,430,769 | B1 | 8/2002 | Allen | |
| 7,043,789 | B2 | 5/2006 | Morrish | |
| 7,179,042 | B1 * | 2/2007 | Hartmann | B65G 69/30 14/69.5 |
| 7,549,692 | B2 | 6/2009 | Washington | |
| 7,950,094 | B2 * | 5/2011 | Bailie | B65G 69/30 14/69.5 |

(Continued)

FOREIGN PATENT DOCUMENTS

| | | | | |
|---|---|---|---|---|
| GB | 2276592 | | 10/1994 | |
| GB | 2276592 | A * | 10/1994 | A61G 3/061 |

OTHER PUBLICATIONS

Website, http://www.discountramps.com/portable-aluminum-ramps/p/TWR-WC-RAMPS-V2/, "Aluminum Telescoping Wheelchair Track Ramps—600 lb. Capacity," two sheets printed from the internet on Aug. 17, 2015.

*Primary Examiner* — Abigail A Risic
(74) *Attorney, Agent, or Firm* — Richard C. Litman

(57) ABSTRACT

The portable folding ramp facilitates transfer of large, heavy objects that cannot be conveniently hand carried up and down inclines (steps, etc.). The portable folding ramp includes one or more ramp members (preferably two, and perhaps three) that attach removably to a folding crossmember. The crossmember includes an elongate slot with a series of short positioning slots extending transversely therefrom. Each ramp member includes a pin at its upper end, with the pin installing removably in the elongate slot. The pin (and its ramp member) is then positioned along the elongate slot to the desired positioning slot to set the lateral spacing between ramps. The apparatus is folded for storage by (a) retracting the telescoping ramp(s), (b) folding the crossmember back upon itself, (c) positioning the ramp(s) attachment(s) at the extreme ends of the crossmember, and (d) pivoting the ramp(s) to align with the crossmember. A storage container is provided.

16 Claims, 10 Drawing Sheets

(56) References Cited

U.S. PATENT DOCUMENTS

| | | | | |
|---|---|---|---|---|
| 8,821,102 | B1 * | 9/2014 | Boguslawski | B65G 69/30<br>14/71.1 |
| 2002/0144364 | A1 * | 10/2002 | Anderson | E01C 9/083<br>14/69.5 |
| 2004/0083562 | A1 * | 5/2004 | Leblanc | B65G 69/30<br>14/69.5 |
| 2013/0091639 | A1 * | 4/2013 | Romanak | B60P 1/43<br>14/71.1 |
| 2014/0196225 | A1 * | 7/2014 | Bunker, II | B65G 69/30<br>14/69.5 |

* cited by examiner

PORTABLE FOLDING RAMP

BACKGROUND OF THE INVENTION

1. Field of the Invention

The present invention relates generally to portable devices for scaling inclines and the like, and particularly to a portable folding ramp to facilitate movement of large and heavy wheeled articles, e.g., persons in wheelchairs, up and down stairways and the like.

2. Description of the Related Art

The transport or movement of large, heavy, and or bulky objects that cannot be reasonably carried by a person up and down stairs and/or other inclines, is an ongoing problem. Innumerable devices, systems, and mechanisms have been developed in the past as solutions to this problem, including elevators, ladders, and other devices.

A subset of the above problem is the challenge of moving an object up and down a stairway or a set of steps. This is increasingly important in the modern world, as greater attention to the needs of paraplegics and others with limited mobility has been given. In many areas of the world, laws have been passed that require provisions for access to public places for persons having such handicaps. This has resulted in wheelchair ramps and other accommodations for such people, with such accommodations also aiding the movement of large appliances, furniture dollies, and other such large and heavy objects.

The above-noted laws and rules generally apply only to places with public access. They do not generally apply to private homes, and in many areas of the world such laws and rules requiring public access have not been implemented. Accordingly, a number of stair-climbing devices, ramps, and other mechanisms and devices have been developed in the past in response to this problem. These are often temporary installations that are removed once the object (e.g., a large and heavy appliance) has been moved up or down the incline, but most are relatively crude planks with little or no provision for compact storage. While some such devices capable of disassembly and/or folding have been developed in the past, they are generally still too bulky for convenient transport by a person in a wheelchair or the like for use by that person when the need arises.

Thus, a portable folding ramp solving the aforementioned problems is desired.

SUMMARY OF THE INVENTION

The portable folding ramp includes at least one ramp member, and preferably two or perhaps three or more such members, that are removably attached to a crossmember at the upper ends of the ramp members. The assembly is particularly well suited for temporary installation upon a stairway within a building structure or the like, having smooth floors, as the crossmember includes a pair of industrial suction cups for temporarily and removably locking the crossmember to the underlying surface.

The crossmember further includes an elongate slot extending substantially from end to end, with a series of shorter slots extending transversely therefrom to permit precise adjustment of the lateral spacing of plural ramp members when installed. Each of the ramp members has an upper end with a pin depending therefrom, with the pin having a large diameter head. The head of the pin is inserted through an opening in the crossmember, and the pin (and upper end of the ramp from which the pin depends) is adjusted along the elongate slot to one of the shorter transverse slots as desired for positioning.

The crossmember is hinged at its center to permit folding. Each of the ramp members comprises a plurality of mutually telescoping sections, for compact storage. The ramps can be removed from the crossmember, or the entire assembly can be folded for compact storage by (a) retracting the telescoping ramp members, (b) sliding the attachment pins of the ramp members to the extreme ends of the elongate slot of the crossmember, (c) folding the crossmember, and (d) pivoting the retracted ramp members about their pins, to align the ramp members with the folded crossmember. (The order of the steps in the above-described procedure is not critical.) A storage container is provided for the folded ramp and crossmember assembly.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The portable folding ramp is configured and constructed for carriage by a person confined to a wheelchair or otherwise having limited mobility for negotiating steps and similar inclines. The portable folding ramp can be deployed by such a person and extended up or down a series of steps or other incline for use by the person of limited mobility, and then folded, stored, and carried by the person for further future use as needed. The portable folding ramp can also be used by moving crews and the like for moving large and heavy articles of furniture, large appliances, and the like, up and down stairs and other inclines.

Figure 1:
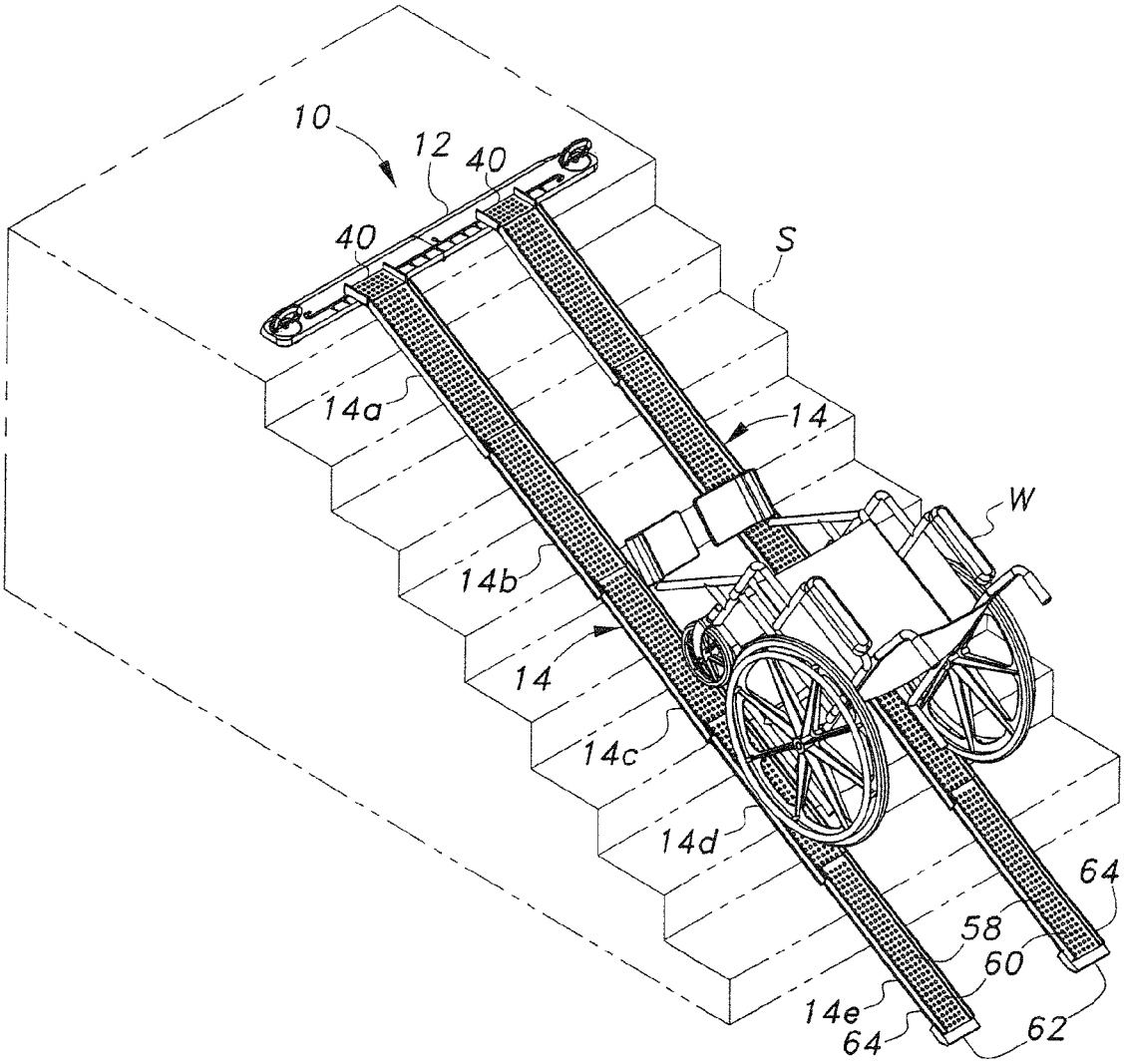
FIG. 1 is an environmental, perspective view of a portable folding ramp according to the present invention, illustrating its general configuration and use.

FIG. 1 of the drawings provides an environmental perspective view of a first embodiment of the portable folding ramp 10, showing its utility in allowing a wheelchair W to ascend or descend a series of stairs or steps S. The portable folding ramp 10 essentially comprises a single folding crossmember 12 having at least one ramp member 14, and preferably two or perhaps more such ramp members, detachably and pivotally connected thereto. The crossmember 12 is placed at the top of the steps S or other incline, and the ramp member(s) 14 are attached to the crossmember 12, spaced laterally as required for the wheels of the wheelchair W (or other structure of the device that is to negotiate the incline), and extended down the steps S or incline for use.

Figure 2:
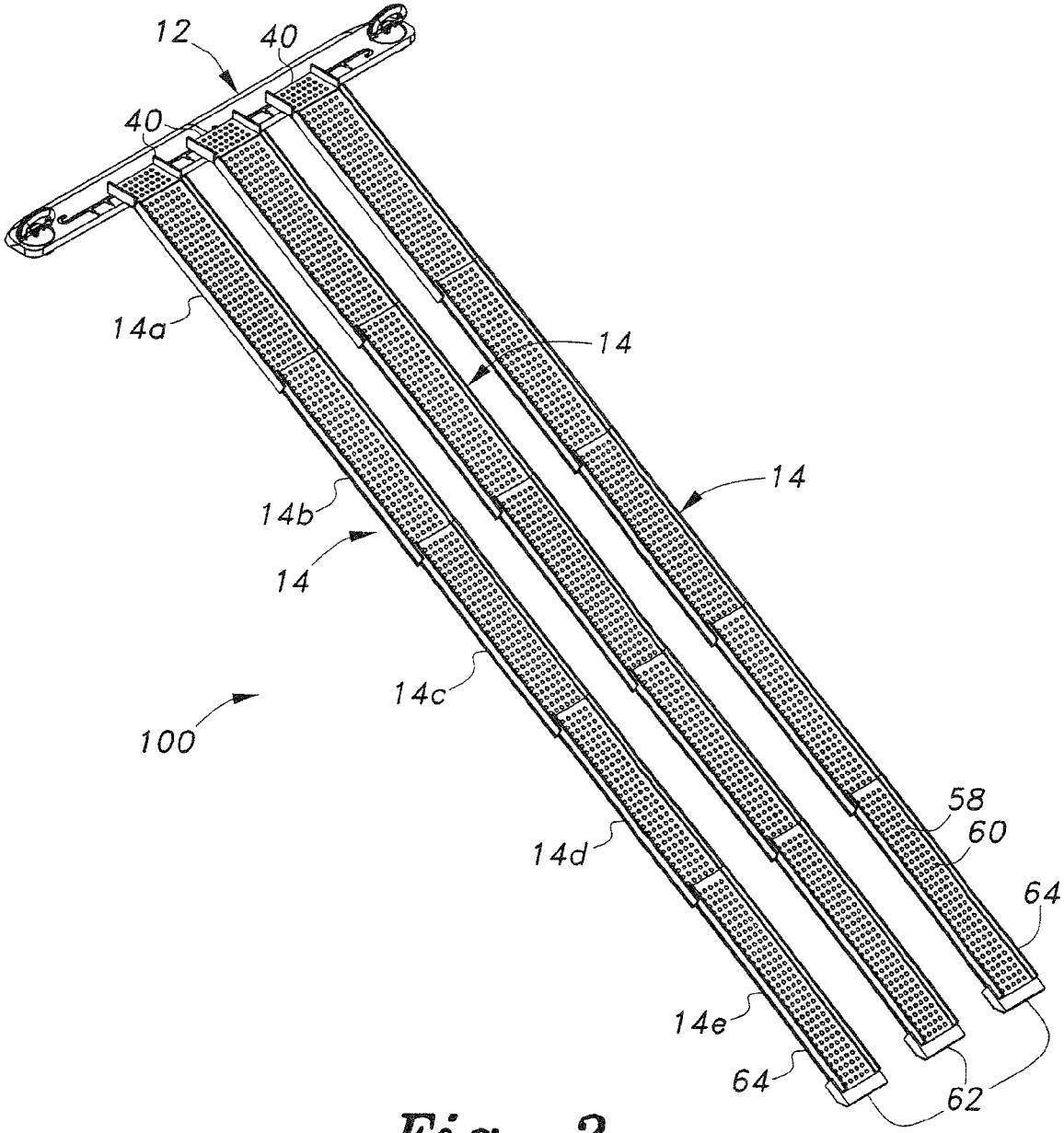
FIG. 2 is a perspective view of an alternative embodiment of the portable folding ramp according to the present invention

FIG. 2 of the drawings is a perspective view of a second embodiment of the portable folding ramp, designated as portable folding ramp 100. The portable folding ramp 100 includes all of the various components of the portable folding ramp 10, but also includes a third ramp member 14. It will be seen that this configuration is exemplary, and that any practicable number of ramp members 14, i.e., one or more, can be detachably assembled with the crossmember 12 as needed.

Figure 3:
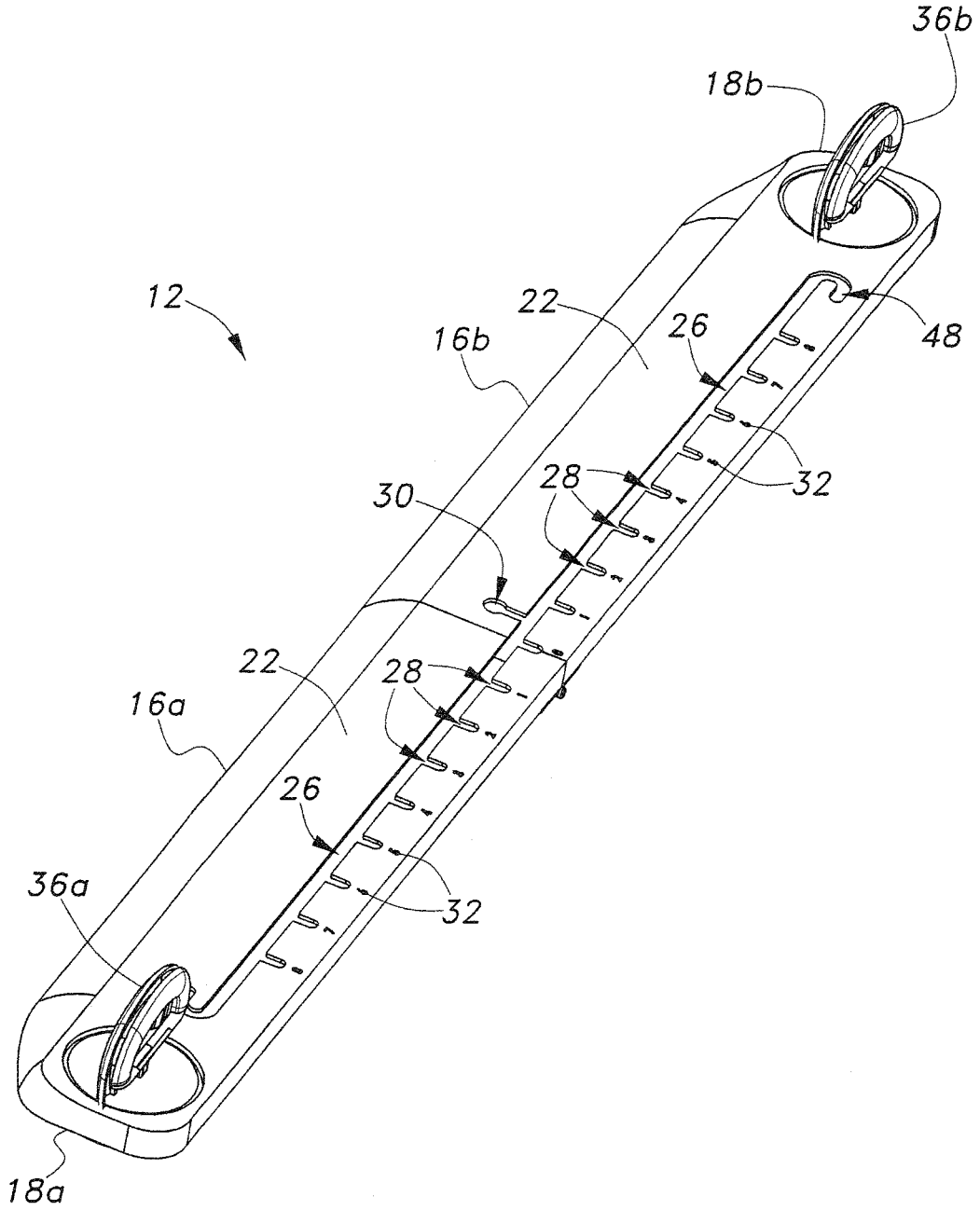
FIG. 3 is a top perspective view of the crossmember component of the portable folding ramp according to the present invention.
Figure 4:
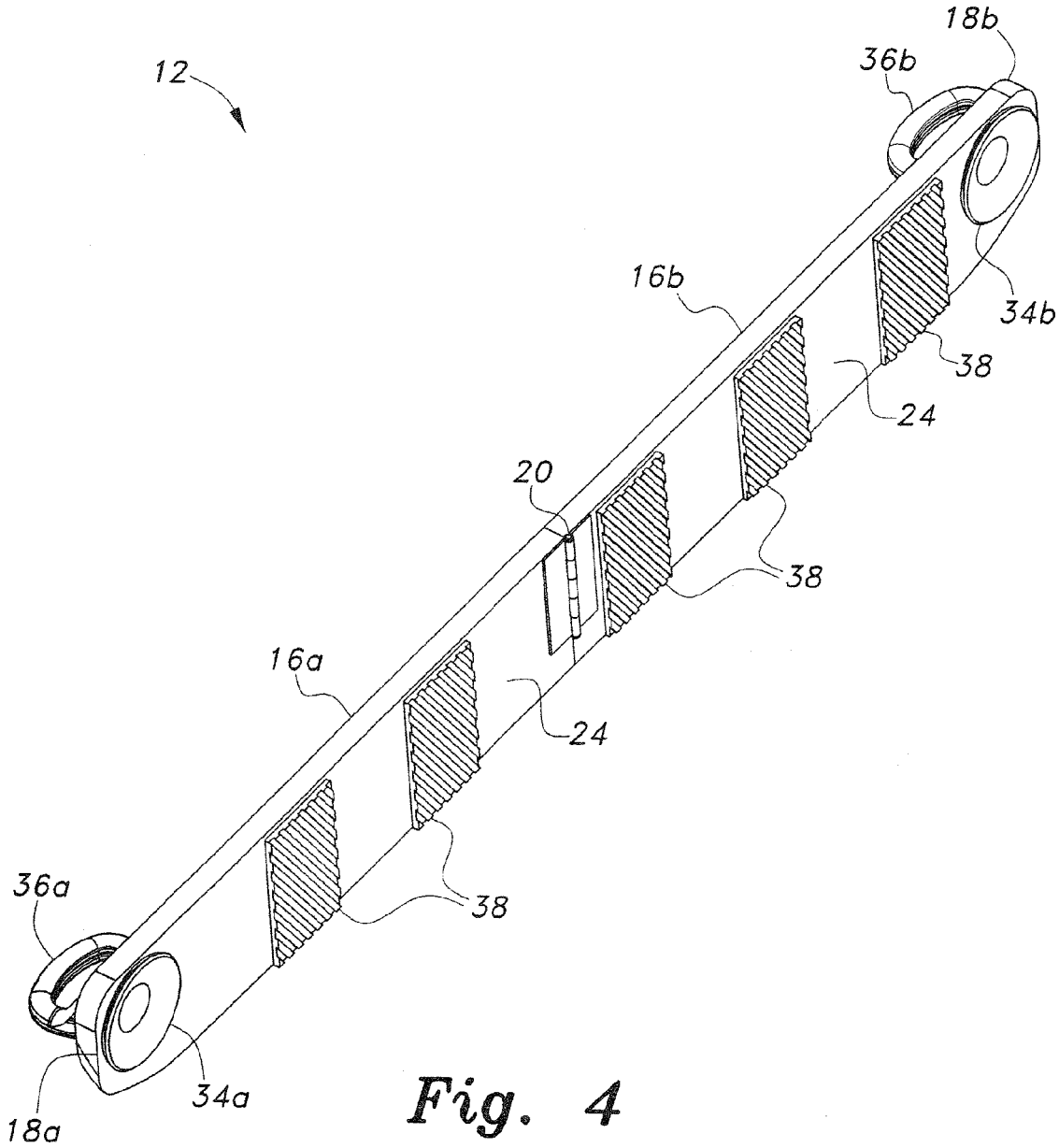
FIG. 4 is a bottom perspective view of the crossmember component of the portable folding ramp according to the present invention.

FIGS. 3 and 4 respectively provide top and bottom perspective views of the crossmember 12. The crossmember 12 comprises a first portion 16*a* having a first end 18*a*, and a second portion 16*b* with a second end 18*b*. The two portions 16*a*, 16*b* are joined by a central hinge 20 (FIG. 4) to allow the two components 16*a*, 16*b* to be folded for storage. The crossmember 12 further includes an upper surface 22 and an opposite lower surface 24 (FIG. 4).

The upper surface 22 provides for the removable attachment of the ramp member(s) 14 thereto. The upper surface 22 of the crossmember 12 includes an elongate primary slot 26 that extends substantially from the first end 18*a* to the opposite second end 18*b*, or at least from points adjacent the first end 18*a* and the second end 18*b* of the crossmember 12. A plurality of relatively short ramp positioning slots 28 extend transversely from the primary slot 26. The primary slot 26 and the shorter ramp positioning slots 28 all have a relatively wide main channel with a narrower upper portion, i.e., overhangs, to capture a compatibly shaped attachment therein and to prevent the attachment from being pulled directly out of the slots. An entrance keyway 30 extends laterally from the primary slot 26 and has a wider entry point to allow the wider head of an attachment, e.g., a ramp attachment pin, to be inserted therein and captured along the slot(s) 26 and/or 28 when the attachment is slid along the slot(s). The shorter ramp positioning slots can be provided with indicia 32 to indicate the positioning of a pin(s) or attachment(s) therein.

The opposite lower surface 24 of the folding crossmember 12 is shown in FIG. 4 of the drawings. The lower surface 24 includes first and second suction cups, respectively 34*a* and 34*b*, adjacent the respective first and second ends 18*a*, 18*b* of the crossmember 12. The suction cups 34*a*, 34*b* are selectively operable by means of handles 36*a*, 36*b* extending from the opposite upper surface 22 of the crossmember 12. Each of the handles 36*a*, 36*b* comprises two parts having a generally D-shaped configuration. Suction is applied to the cups when the handles are pivotally raised from their bases and folded together and released when the two components of each handle are lowered into their bases, as is known in the field of industrial suction cups. This system provides solid positive attachment of the crossmember 12 to any suitable smooth underlying surface, e.g., tile, painted and/or polished wood or other material, polished stone, etc. One or more pads 38 or other components of high friction material, e.g., rubber, soft plastic, etc., may be permanently attached to the lower surface 24 of the folding crossmember 12 for further security when the crossmember 12 is temporarily and removably attached to an underlying surface.

Returning to FIGS. 1 and 2, it will be noted that each extended ramp member 14 comprises five sections, designated as ramp sections 14*a* through 14*e*. These ramp sections 14*a* through 14*e* telescope mutually relative to one another, with the distal sections 14*e* being the narrowest and telescoping into the next sections 14*d*, the sections 14*d* telescoping into the medial sections 14*c*, etc. FIGS. 6A through 9, discussed in detail further below, illustrate the completely retracted ramp sections. This not only allows the ramps 14 to be retracted to a compact length for convenient storage and carriage, but also provides for partial extension of the ramps 14 for relatively shorter inclines or stairways.

Figure 5:
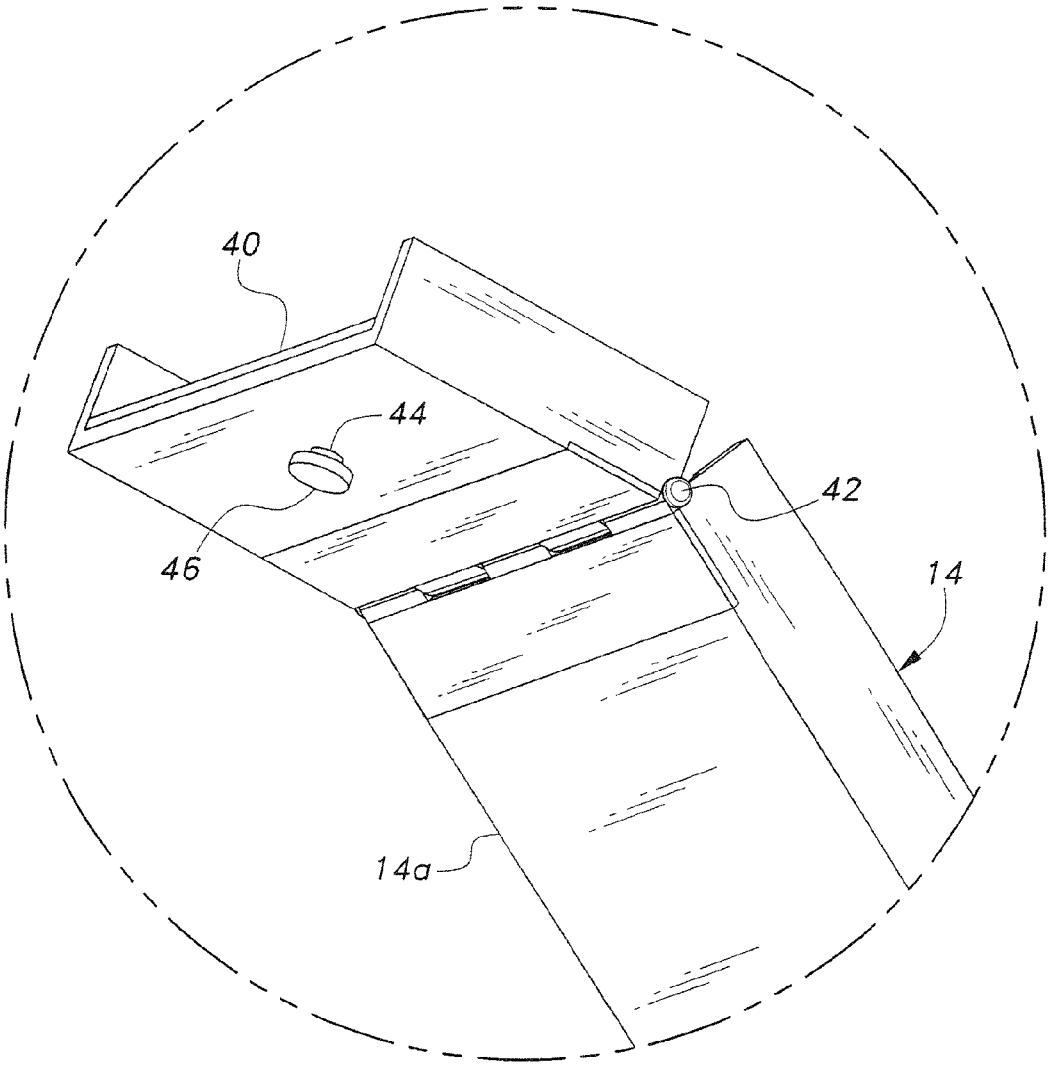
FIG. 5 is a bottom perspective view showing the detail of the ramp attachment to the crossmember component of the portable folding ramp according to the present invention.

FIG. 5 of the drawings provides a detailed illustration of the first end 40 of a ramp member 14, showing the means for attaching the ramp members 14 to the crossmember 12. Each ramp member 14, or more specifically each of the first ramp sections 14*a*, includes a first end 40 that is attached to the ramp section 14*a* by a hinge 42. This allows the crossmember 12 to be placed upon a level landing or the like, with the ramp members 14 extending down a slope of some variable angle. A crossmember attachment pin 44 depends from the underside of the first end 40, with the pin 42 having a larger diameter head 46. The ramp members 14 are adjustably and removably secured to the crossmember 12 by inserting the head 46 of the pin 44 through the larger diameter passage at the end of the entrance keyway slot 30 (FIGS. 3 and 6A through 6C) in the upper surface 22 of the crossmember 12, sliding the pin 44 into the narrower portion of the keyway slot 30 to capture the head 46 of the pin 44 beneath the overlying edges of the slot, further sliding the pin 44 along the primary slot 26 of the crossmember 12 in the direction and to the location desired, and finally positioning the pin 44 in the desired one of the transverse ramp positioning slots 28 of the crossmember 12. Disassembly of the ramps 14 from the crossmember 12 is accomplished by reversing the above-described installation procedure.

Figure 6A:
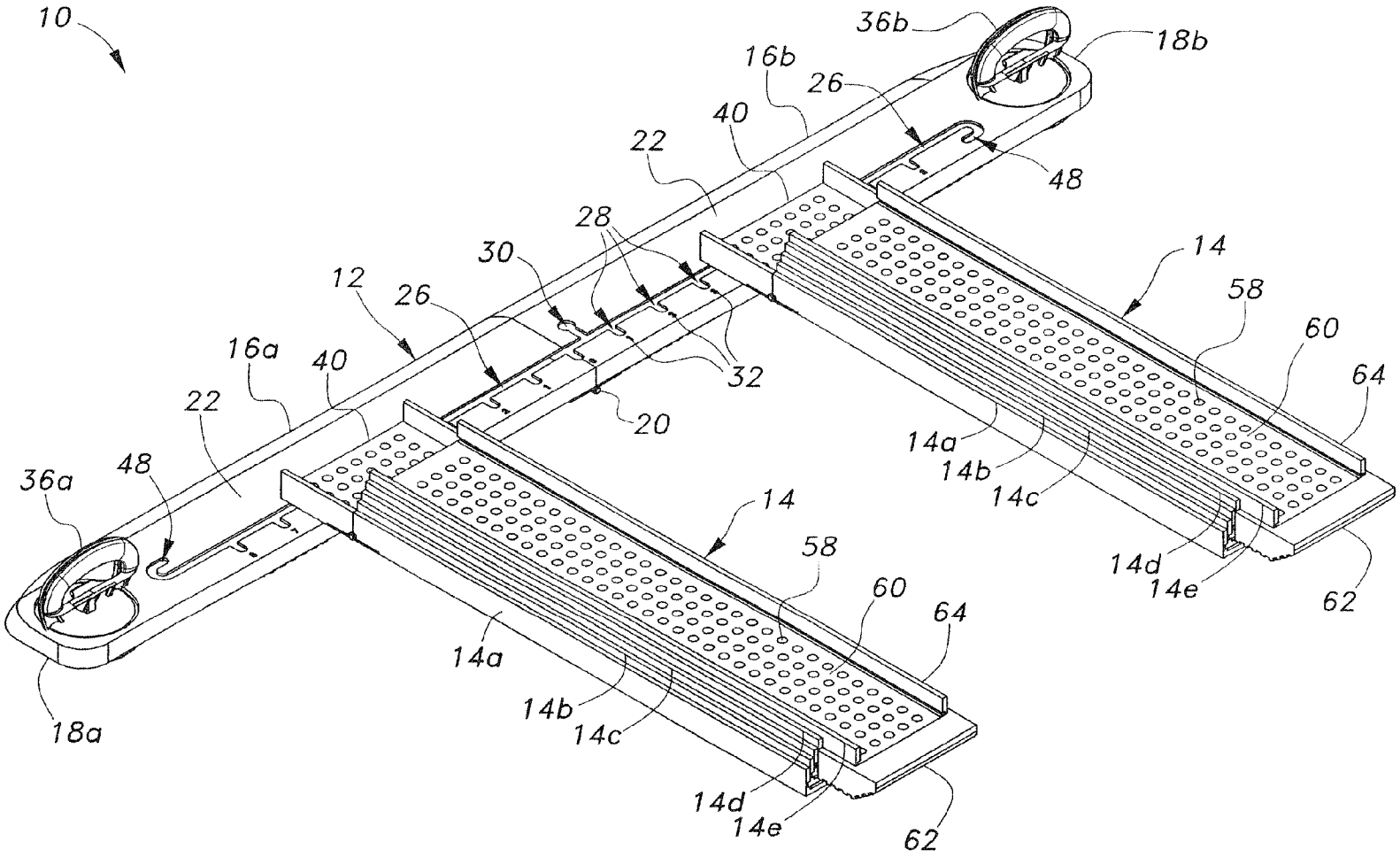
FIG. 6A is a perspective view of the portable folding ramp of FIG. 1, showing the two ramps in their retracted configuration.

FIGS. 6A through 6D provide a series of four progressive views illustrating the procedure for folding the portable folding ramp 10 for compact storage. In FIG. 6A, the two ramp members 14 have been retracted, with the ramp sections 14*b*, 14*c*, 14*d*, and 14*e* retracted into one another and into the larger section 14*a*. The ramp members 14 can remain attached to the crossmember 12 throughout this process if so desired, as shown in FIGS. 6A through 6D.

Figure 6B:
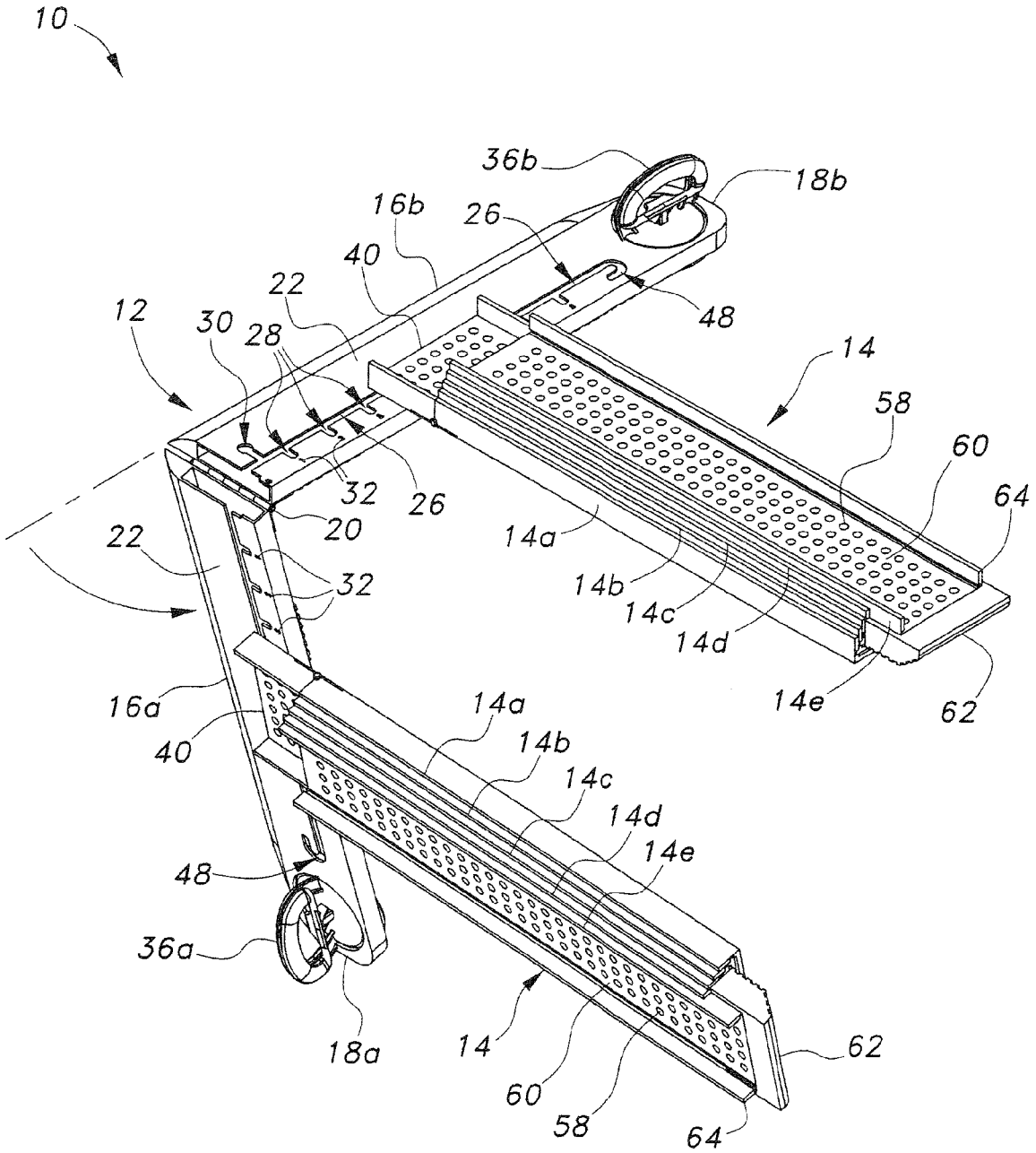
FIG. 6B is a perspective view of the portable folding ramp of FIG. 6A, showing the crossmember partially folded.
Figure 6C:
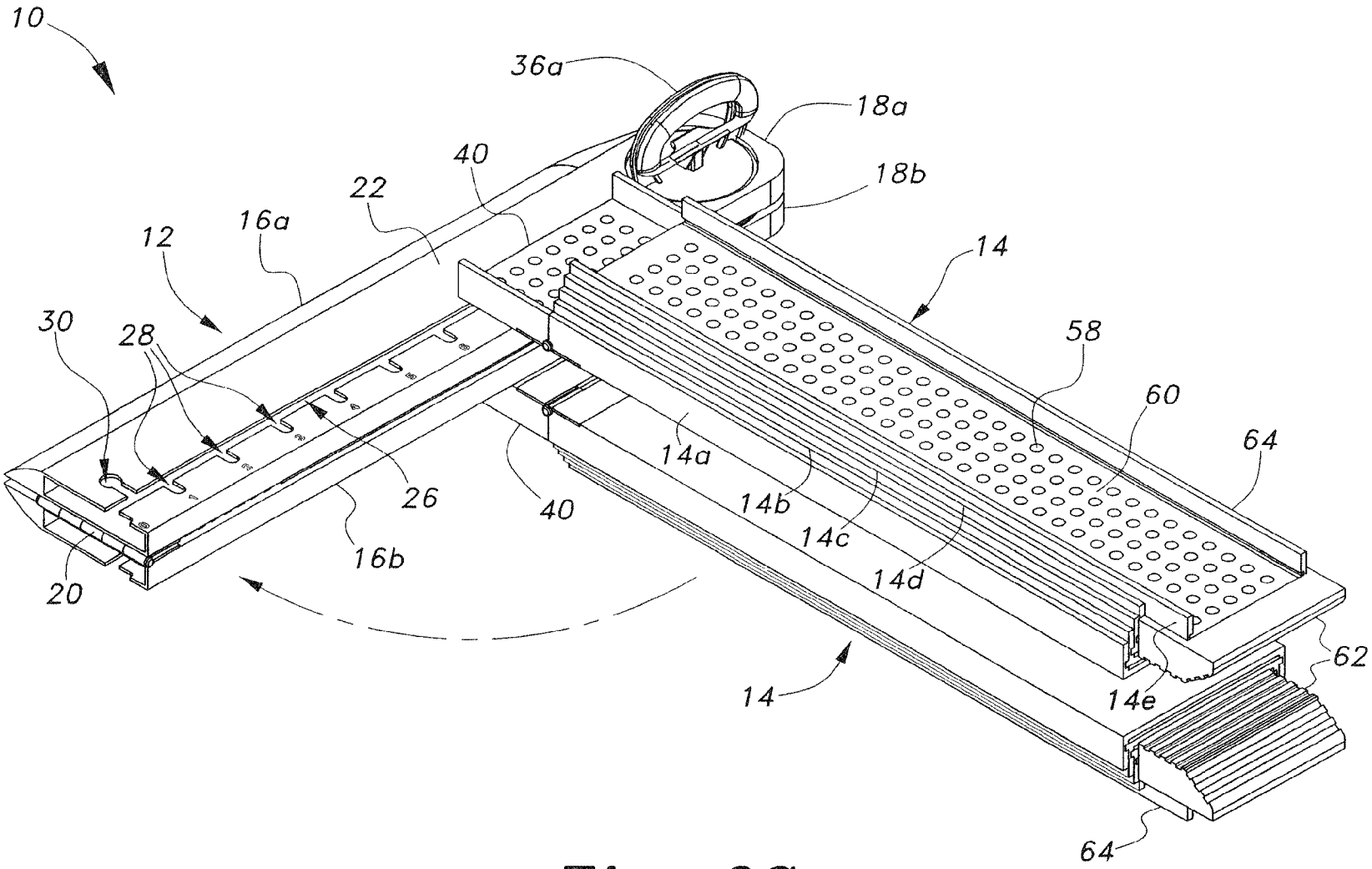
FIG. 6C is a perspective view of the portable folding ramp of FIG. 6B, showing the crossmember completely folded with one of the two ramps overlying the other.

In FIG. 6B, the crossmember 12 is shown partially folded about its hinge 20. The crossmember 12 folding process continues until the first and second portions 16*a* and 16*b* of the crossmember 12 are folded together with their underlying or lower surfaces 24 immediately adjacent one another, as shown in FIG. 6C. It will also be noted in FIG. 6C that the ramp members 14 have been repositioned from their positions shown in FIGS. 6A and 6B, with their first ends 40 immediately adjacent the ends 18*a*, 18*b* of the crossmember 12. This is accomplished by sliding the crossmember attachment pin 44 from its transverse ramp positioning slot 28 and along the primary slot 26 of the crossmember 12, until the pin 44 reaches a hook-shaped or J-shaped ramp storage retaining slot 48 adjacent each end 18*a*, 18*b* of the crossmember 12. When the crossmember attachment pins 44 of the ramps 14 are situated in these retaining slots 48 in the folded crossmember 12, the assembly will appear generally as shown in FIG. 6C.

Figure 6D:
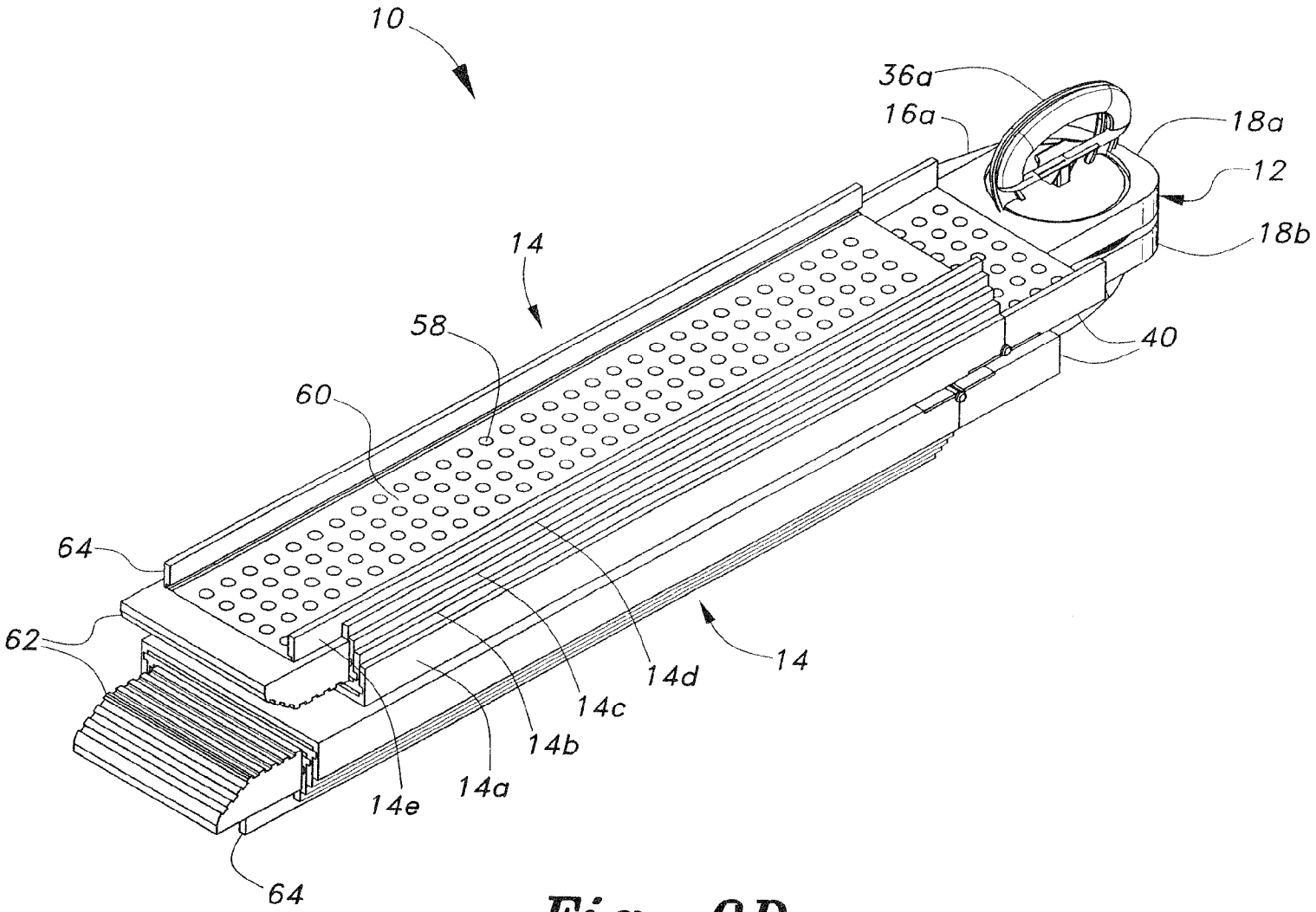
FIG. 6D is a perspective view of the portable folding ramp of FIG. 6C, showing the two retracted ramps pivoted to orient the ramps in the same direction as the folded crossmember.

In FIG. 6D, the ramps 14 have been pivoted to lie parallel to the folded portions or sections of the crossmember 12. As the crossmember attachment pins 44 of the ramps 14 have circular cross-sections, the ramps 14 can be pivotally aligned at any desired angle relative to the span of the crossmember 12. This permits the retracted ramp sections 14*a* through 14*e* to be pivotally aligned with the folded portions of the crossmember 12 for more compact storage of the assembly, as shown in FIG. 6D.

Figure 7:
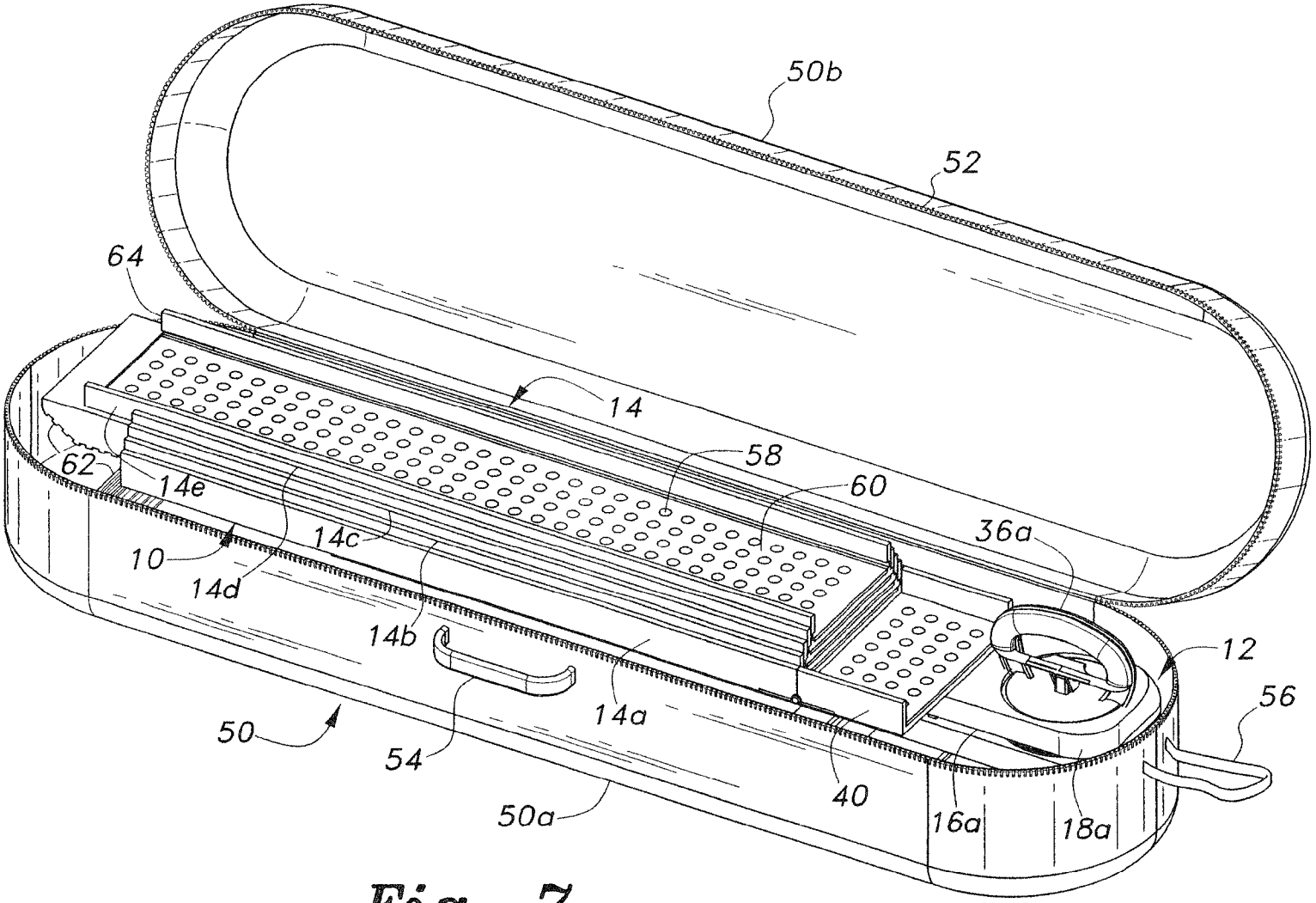
FIG. 7 is a perspective view of the portable folding ramp according to the present invention, showing the folded ramp assembly of FIG. 6D placed in a storage and carrying container.

The completely folded portable folding ramp 10 as shown in FIG. 6D can be conveniently stored in a storage container 50, as shown in FIG. 7. The container 50 comprises a lower portion 50*a* with a lid 50*b*, the container 50 being closed by a zipper 52 or other suitable closure means so secure the lid 50*b* completely to the lower portion 50*a*. The storage container 50 preferably includes a carrying handle 54 and/or accessory attachment loop 56, as well.

Accordingly, the portable folding ramp 10 and/or any of its related embodiments can be easily carried by a physically handicapped person for use as needed. For example, the attachment loop 56 of the storage container 50 allows the container 50 to be suspended from the handgrip of a wheelchair or the like until needed. The user need only reach around to access the storage container 50, open the container, and deploy the portable folding ramp 10 generally in the reverse order of the steps for storage illustrated in FIGS. 6A through 6D and described further above. Additional security is provided for the user by providing a high friction surface 58 on the upper face 60 of the ramp members 14, e.g., a textured or pierced surface as shown in FIGS. 1, 2, and 6A through 7, or other high friction surface as desired. Further security to prevent undesired shifting of the distal ends of the ramp members 14 is provided by a high friction surface 62, e.g., rubberized cleats, etc., disposed beneath the distal second ends 64 of the ramp members 14, as shown in FIGS. 1, 2, and 6A through 7.

It is to be understood that the present invention is not limited to the embodiments described above, but encompasses any and all embodiments within the scope of the following claims.

I claim:

1. A portable folding ramp, comprising:

a single folding crossmember having a first portion and a second portion joined by a central hinge;

the crossmember having a first end, a second end opposite the first end, an upper surface, and a lower surface opposite the upper surface, the crossmember further having an elongate primary slot extending substantially from the first end to the second end thereof along the upper surface and a plurality of ramp positioning slots extending transversely from the primary slot;

a pin depending from the first end of the at least one ramp member, the pin selectively installing through the elongate slot and into one of the ramp positioning slots of the crossmember; and at least one ramp member having a first end and a second end opposite the first end, the first end of the at least one ramp member being selectively attached to the crossmember, the at least one ramp member thereby extending from the crossmember.

2. The portable folding ramp according to claim 1, further comprising:

the crossmember having a first end, a second end opposite the first end, an upper surface, and a lower surface opposite the upper surface; and a selectively operable suction cup disposed upon the lower surface of the crossmember, adjacent each end thereof.

3. The portable folding ramp according to claim 1, further comprising the at least one ramp member having a plurality of mutually telescoping sections, the first end of the at least one ramp member being selectively pivotally attached to the crossmember.

4. The portable folding ramp according to claim 1, further comprising a storage container.

5. The portable folding ramp according to claim 1, further comprising:

a first ramp member;

a second ramp member, and a third ramp member.

6. The portable folding ramp according to claim 1, further comprising:

the at least one ramp member having an upper face with a high friction surface disposed thereupon and beneath the second end thereof; and the lower surface of the crossmember having high friction material disposed thereon.

7. A portable folding ramp, comprising:

a single crossmember having a first end, a second end opposite the first end, an upper surface, and a lower surface opposite the upper surface, the crossmember further having an elongate primary slot extending substantially from the first end to the second end thereof along the upper surface and a plurality of ramp positioning slots extending transversely from the primary slot;

the crossmember having a first portion and a second portion joined by a central hinge, the first portion and the second portion of the crossmember selectively folding together by means of the hinge;

at least one ramp member having a first end and a second end opposite the first end; and a pin depending from the first end of the at least one ramp member, the pin selectively installing through the elongate slot and into one of the ramp positioning slots of the crossmember.

8. The portable folding ramp according to claim 7, further comprising a selectively operable suction cup disposed upon the lower surface of the crossmember, adjacent each end thereof.

9. The portable folding ramp according to claim 7, further comprising the at least one ramp member having a plurality of mutually telescoping sections, the first end of the at least one ramp member being selectively pivotally attached to the crossmember.

10. The portable folding ramp according to claim 7, further comprising a storage container.

11. The portable folding ramp according to claim 7, further comprising:

a first ramp member;

a second ramp member, and a third ramp member.

12. The portable folding ramp according to claim 7, further comprising:

the at least one ramp member having an upper face with a high friction surface disposed thereupon and beneath the second end thereof; and the lower surface of the crossmember having high friction material disposed thereon.

13. A portable folding ramp, comprising:

a single crossmember having a first end, a second end opposite the first end, an upper surface, and a lower surface opposite the upper surface;

a selectively operable suction cup disposed upon the lower surface of the crossmember, adjacent each end thereof; and at least one ramp member having a first end and a second end opposite the first end, the first end of the at least one ramp member being selectively attached to the crossmember, the at least one ramp member thereby extending from the crossmember;

wherein the crossmember having a first portion and a second portion joined by a central hinge, the first portion and the second portion of the crossmember selectively folding together by means of the hinge; and wherein the crossmember having an elongate primary slot extending substantially from the first end to the second end thereof along the upper surface and a plurality of ramp positioning slots extending transversely from the primary slot; and a pin depending from the first end of the at least one ramp member, the pin selectively installing through the elongate slot and into one of the ramp positioning slots of the crossmember.

14. The portable folding ramp according to claim 13, further comprising:

the at least one ramp member having a plurality of mutually telescoping sections, the first end of the at least one ramp member being selectively pivotally attached to the crossmember; and a storage container.

15. The portable folding ramp according to claim 13, further comprising:

a first ramp member;

a second ramp member, and a third ramp member.

16. The portable folding ramp according to claim 13, further comprising:

the at least one ramp member having an upper face with a high friction surface disposed thereupon and beneath the second end thereof; and the lower surface of the crossmember having high friction material disposed thereon.

* * * * *